US011769444B2

(12) United States Patent
Yao et al.

(10) Patent No.: US 11,769,444 B2
(45) Date of Patent: Sep. 26, 2023

(54) DISPLAY PANEL AND DISPLAY DEVICE WITH VIRTUAL PIXEL CIRCUIT

(71) Applicant: KunShan Go-Visionox Opto-Electronics Co., Ltd., Jiangsu (CN)

(72) Inventors: Yuan Yao, Kunshan (CN); Shuai Ye, Kunshan (CN); Xiyang Jia, Kunshan (CN); Zhengyong Zhu, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/690,373

(22) Filed: Mar. 9, 2022

(65) Prior Publication Data

US 2022/0199004 A1 Jun. 23, 2022

Related U.S. Application Data

(63) Continuation of application No. PCT/CN2021/083388, filed on Mar. 26, 2021.

(30) Foreign Application Priority Data

Apr. 17, 2020 (CN) ..... 202010308108.2

(51) Int. Cl.
*G09G 3/32* (2016.01)

(52) U.S. Cl.
CPC ..... *G09G 3/32* (2013.01); *G09G 2300/0413* (2013.01); *G09G 2300/0819* (2013.01);
(Continued)

(58) Field of Classification Search
CPC ... G09G 3/32–3291; G09G 2300/0413; G09G 2300/0421; G09G 2300/043;
(Continued)

(56) References Cited

U.S. PATENT DOCUMENTS

2015/0294618 A1 10/2015 Park et al.
2016/0218155 A1* 7/2016 Park ..... G09G 3/3233
(Continued)

FOREIGN PATENT DOCUMENTS

CN 105845082 A 8/2016
CN 107134473 A 9/2017
(Continued)

OTHER PUBLICATIONS

Chinese First office action for Application No. 202010308108.2 dated Jul. 13, 2021; 19 pgs.
(Continued)

*Primary Examiner* — Nathan Danielsen
(74) *Attorney, Agent, or Firm* — Maier & Maier, PLLC

(57) ABSTRACT

A display panel and a display device. The display panel includes a first area and a second area, and a plurality of first pixel rows and a plurality of second pixel rows, each of the first pixel row and the second pixel row includes a plurality of pixels. The number of the pixels of each first pixel row is greater than the number of the pixels of each second pixel row. The pixels in the first pixel row are display pixels, and the plurality of pixels in the second pixel row are display pixels and virtual pixels. The display pixel includes a display pixel circuit, the virtual pixel includes a virtual pixel circuit, and the virtual pixel circuit includes a compensation unit.

17 Claims, 6 Drawing Sheets

(52) U.S. Cl.
CPC ..... *G09G 2300/0842* (2013.01); *G09G 2310/061* (2013.01); *G09G 2320/0233* (2013.01)

(58) Field of Classification Search
CPC ... G09G 2300/0439; G09G 2300/0452; G09G 2300/0819; G09G 2300/0842; G09G 2310/0232; G09G 2310/0251; G09G 2310/04–061; G09G 2310/08; G09G 2320/0233; G09G 2320/029; G09G 2320/0295; G09G 2320/0686; G09G 2320/0693
See application file for complete search history.

(56) References Cited

U.S. PATENT DOCUMENTS

| | | | | |
|---|---|---|---|---|
| 2018/0090061 | A1 | 3/2018 | Kim et al. | |
| 2019/0108789 | A1 | 4/2019 | Tsuge | |
| 2020/0176551 | A1* | 6/2020 | Park | G09G 3/3225 |
| 2020/0380915 | A1* | 12/2020 | Yoon | G09G 3/3225 |
| 2021/0065625 | A1* | 3/2021 | Wang | G09G 3/3233 |
| 2021/0398482 | A1* | 12/2021 | Wang | G09G 3/3233 |

FOREIGN PATENT DOCUMENTS

| | | | |
|---|---|---|---|
| CN | 107481669 | A | 12/2017 |
| CN | 107633807 | A | 1/2018 |
| CN | 107871767 | A | 4/2018 |
| CN | 107993579 | A | 5/2018 |
| CN | 107994060 | A | 5/2018 |
| CN | 108010947 | A | 5/2018 |
| CN | 108352151 | A | 7/2018 |
| CN | 108550609 | A | 9/2018 |
| CN | 108828861 | A | 11/2018 |
| CN | 110444120 | A | 11/2019 |
| CN | 110649080 | A | 1/2020 |
| CN | 111599282 | A | 8/2020 |
| CN | 112562522 | A | 3/2021 |
| JP | 2018534613 | A | 11/2018 |
| JP | 2020504873 | A | 2/2020 |

OTHER PUBLICATIONS

Chinese second office action for Application No. 202010308108.2 dated Sep. 8, 2021; 12 pgs.
Notification to Grant Patent Right for Invention for Application No. 202010308108.2 dated Nov. 2, 2021; 6 pgs.
International search report for Application No. PCT/CN2021/083388 dated Jun. 23, 2021; 17 pgs.
Search Report dated Sep. 13, 2022, in connection with corresponding European Application No. 21787846.1; 19 pages.
Notice of Reasons for Refusal dated May 9, 2023, in corresponding Japanese Application No. 2022-528192, 6 pages.

* cited by examiner

DISPLAY PANEL AND DISPLAY DEVICE WITH VIRTUAL PIXEL CIRCUIT

CROSS REFERENCE TO RELATED DISCLOSURES

The present application is a continuation-application of International Patent Application No. PCT/CN2021/083388 filed on Mar. 26, 2021, which claims the foreign priority of Chinese Patent Application No. 202010308108.2, filed on Apr. 17, 2020, the entire contents of which are hereby incorporated by reference in its entirety.

TECHNICAL FIELD

The present disclosure relates to the field of display technology, and in particular, to a display panel and a display device.

BACKGROUND

With the characteristics of a large screen proportion and a narrow frame, a comprehensive screen can greatly improve the visual effect of users, so the comprehensive screen has attracted extensive attention. Currently, in a display device with comprehensive screen, in order to realize the functions of selfie, visual call and fingerprint identification, a special-shaped area is usually set on the front of the display device. The special-shaped area is configured to install a camera, earpiece, fingerprint identification sensor, or physical keys.

However, the load and number of pixels will be changed by setting the special-shaped area on the display device, which resulting in uneven pixel display, and further resulting in abnormal display.

SUMMARY

The present disclosure provides a display panel and a display device, which is configured to improve the display effect.

In order to overcome the aforementioned technical problems, the first aspect is provided by the present disclosure is a display panel, includes a first area and a second area, including a plurality of first pixel rows, and each of the first pixel rows comprising a plurality of pixels; a plurality of second pixel rows, and each of the second pixel rows include a plurality of pixels, the number of the pixels of each first pixel row is greater than the number of the pixels of each second pixel row; the plurality of pixels of the first pixel row are a plurality of display pixels, and the plurality of the pixels of the second pixel row are a plurality of display pixels and a plurality of virtual pixels; each of the plurality of display pixels includes a display pixel circuit, each of the plurality of virtual pixels includes a virtual pixel circuit, the virtual pixel circuit includes a compensation unit, and the virtual pixel circuit is configured to compensate the display pixel circuits of one of the plurality of second pixel rows when the display pixel circuits of the one of the plurality of second pixel rows are reset; so that, after the display pixel circuits in both the first area and the second area are reset, a voltage difference of nodes of light-emitting devices corresponding to the display pixel circuits is reduced.

Furthermore, each of the display pixel circuit and the virtual pixel circuit includes: a writing unit, configured to receive a first scanning signal; a driving unit, wherein the driving unit is connected to the writing unit by a driving node, and the writing unit is driven by the first scanning signal to write a data signal to the driving node in a writing stage; a control unit, configured to receive an enable signal, and wherein the control unit is connected to the driving unit, so that the driving unit is connected to a power signal line by the control unit; a reset unit, configured to receive a second scanning signal, wherein the reset unit is connected to the driving node and the control unit, the reset unit is driven by the second scanning signal to receive a reference signal, and the reset unit resets the driving node and a first node which is between the reset unit and the control unit according to the reference signal; wherein, the first node of the control unit of the display pixel circuit is connected to a light-emitting device, and the driving node of the virtual pixel circuit is connected to the compensation unit.

Furthermore, the pixels of both the plurality of first pixel rows and the plurality of second pixel rows receive a same reference signal, and the reset units of the display pixel circuits and the reset units of the virtual pixel circuits which are disposed in one of the plurality of second pixel rows are connected to the same reference signal line.

Furthermore, the virtual pixel circuit does not include the light-emitting device.

Furthermore, the compensation unit is a compensation capacitor or a compensation resistor.

Furthermore, the compensation unit is the compensation capacitor, one end of the compensation unit is connected to the driving node, and the other end of the compensation unit is connected to a power signal line.

Furthermore, the number of compensation capacitors is less than or equal to the number of the virtual pixels.

Furthermore, the number of compensation capacitors is a difference between the number of the pixels in the first pixel row and the second pixel row.

Furthermore, the second area includes a virtual pixel area, wherein the virtual pixel area includes two hole-punching areas and an isolation area between the two hole-punching areas, and the plurality of virtual pixels is located in the isolation area.

Furthermore, the writing unit includes a first transistor, including a first pathway terminal, a second pathway terminal, and a control terminal; wherein, the first pathway terminal of the first transistor is connected to the data signal line and configured to receive the data signal, the second pathway terminal of the first transistor is connected to the driving unit and the control unit, and the control terminal of the first transistor is connected to a first scanning signal line and configured to receive the first scanning signal. A second transistor includes a first pathway terminal, a second pathway terminal, and a control terminal; wherein, the first pathway terminal of the second transistor is connected to the driving unit, the second pathway terminal of the second transistor is connected to the driving unit and the control unit, and the control terminal of the second transistor is connected to the first scanning signal line and configured to receive the first scanning signal.

Furthermore, the driving unit includes a third transistor, including a first pathway terminal, a second pathway terminal, and a control terminal; wherein, the first pathway terminal of the third transistor is connected to the control unit and the writing unit, and the second pathway terminal of the third transistor is connected to the control unit and the writing unit, the control terminal of the third transistor is connected to the reset unit and the writing unit.

Furthermore, the reset unit includes: a first reset sub-unit, configured to receive a first scanning reset sub-signal and the reference signal; wherein the first reset sub-unit is connected to the driving node, and the first reset sub-unit resets the driving node by using the reference signal during a first reset sub-period corresponding to the first scanning reset sub-signal. A second reset sub-unit, configured to receive a second scanning reset sub-signal and the reference signal; wherein the second reset sub-unit is connected to the first node and the second reset sub-unit resets the first node by using the reference signal during a second reset sub-period corresponding to the second scanning reset sub-signal.

Furthermore, the first reset sub-unit includes: a fourth transistor, including a first pathway terminal, a second pathway terminal and a control terminal; wherein the first pathway terminal of the fourth transistor is connected to the driving node, the second pathway terminal of the fourth transistor is connected to a reference signal line and configured to receive the reference signal, and the control terminal of the fourth transistor is connected to the first scanning reset sub-signal line and configured to receive the first scanning reset sub-signal.

Furthermore, the second reset sub-unit includes: a fifth transistor, including a first pathway terminal, a second pathway terminal and a control terminal; wherein, the first pathway terminal of the fifth transistor is connected to the first node, the second pathway terminal of the fifth transistor is connected to the reference signal line and configured to receive the reference signal, and the control terminal of the fifth transistor is connected to a second scanning reset sub-signal line and configured to receive the second scanning reset sub-signal.

Furthermore, the control unit includes: a sixth transistor, including a first pathway terminal, a second pathway terminal, and a control terminal; wherein, the first pathway terminal of the sixth transistor is connected to the power signal line and configured to receive the power signal, the second pathway terminal of the sixth transistor is connected to the driving unit, and the control terminal of the sixth transistor is connected to an enable signal line and configured to receive the enable signal. A seventh transistor, including a first pathway terminal, a second pathway terminal, and a control terminal; wherein, the first pathway terminal of the seventh transistor is connected to the second pathway terminal of the sixth transistor, the second pathway terminal of the seventh transistor is connected to the first node, and the control terminal of the seventh transistor is connected to the enable signal line and configured to receive the enable signal.

Furthermore, each of the display pixel circuit and the virtual pixel circuit further includes: a storage capacitor, including a first pathway terminal and a second pathway terminal; wherein the first pathway terminal of the storage capacitor is connected to the power signal line, and the second pathway terminal of the storage capacitor is connected to the driving unit.

In order to overcome the above technical problems, the second aspect is provided in the present disclosure is a display device, which includes the display panel described in any one of the above display panel.

The beneficial effect of the present disclosure: different from the prior art, the present disclosure sets a compensation unit in a virtual pixel circuit, and the virtual pixel circuit is configured to compensate the display pixel circuits when the display pixel circuits which are located in the same one of the second pixel rows. So that after the display pixel circuits in the first area and the second area are reset, the voltage difference at the nodes of the light-emitting devices corresponding to the display pixel circuits is reduced, and the display effect is improved.

DETAILED DESCRIPTION

Figure 1A:
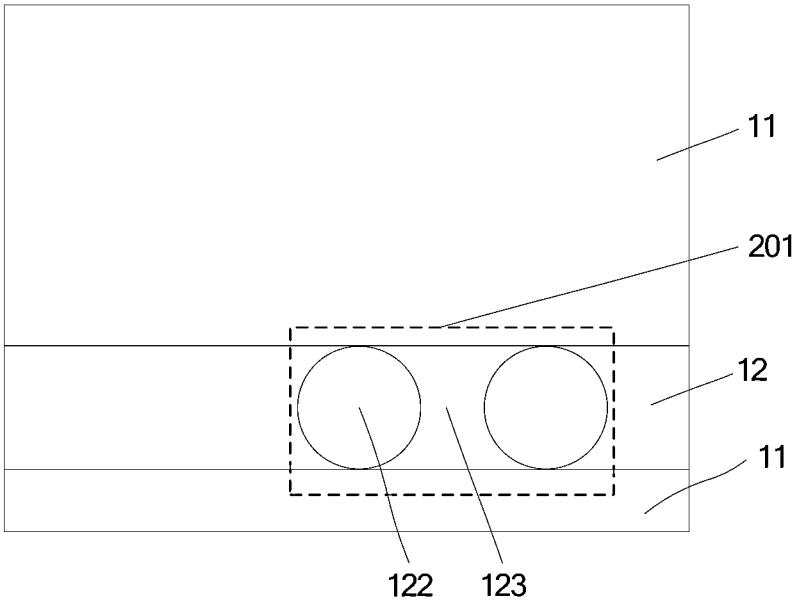
FIGS. 1*a* and 1*b* are structural schematic view of an embodiment of a display panel.

Technical solutions of the embodiments of the present disclosure will be clearly and comprehensively described by referring to the accompanying drawings. Obviously, the embodiments described herein are only a part of, but not all of, the embodiments of the present disclosure. Based on the embodiments in the present disclosure, all other embodiments obtained by a person of ordinary skill in the art without any creative work shall fall within the scope of the present disclosure.

It should be noted that directional indications if present (such as up, down, left, right, front, back, . . . ) in the embodiments of the present disclosure are only expressed to explain relative positional relationships and movement between components in a particular attitude (as shown in the drawings). When the particular attitude is changed, the directional indications shall also be changed accordingly.

In addition, when using expressions "first", "second", and the like in the embodiment of the present disclosure, the expressions "first", "second", and the like are utilized for descriptive purposes only, and shall not be interpreted as indicating or implying relative importance or implicitly specifying the number of an indicated technical feature. Therefore, features defined by "first" and "second" may explicitly or implicitly include at least one of such feature. In addition, technical solutions of various embodiments may be combined with each other, but only on the basis that the technical solutions may be achieved by a person of ordinary skill in the art. When combination of technical solutions appears to be contradictory or unachievable, such combination of technical solutions shall be interpreted as inexistence and excluded from the scope of the present disclosure.

The term "comprising" means "including, but not necessarily limited to"; it specifically indicates open-ended inclusion or membership in a so-described combination, group, series and the like. It should be noted that references to "an" or "one" embodiment in this disclosure are not necessarily to the same embodiment, and such references mean at least one. Unless otherwise defined, all technical and scientific terms used herein have the same meaning as a skilled person in the art would understand. The terminology used in the description of the present disclosure is for the purpose of describing particular embodiments and is not intended to limit the disclosure.

Currently, in a display device with comprehensive screen, in order to realize the functions of selfie, visual call and fingerprint identification, a special-shaped area is usually set on the front of the display device. The special-shaped area is configured to install a camera, earpiece, fingerprint identification, or physical keys. However, by setting the special-shaped area on the display device, the load or number of pixels in the same row corresponding to the special-shaped area maybe changed, and the reset voltage of the pixel circuit of the display area located in the same row with the special-shaped area and connected to the same reference signal line in the reset stage maybe affected, the voltage difference at the node of the light-emitting device (i.e. the anode of the light-emitting device) is caused to be greater after the pixel circuit of the special-shaped area and other areas is reset, a greater difference in the rise time of the anode voltage of the light-emitting device maybe resulted, and a greater difference between the light-emitting time of the pixels in the special-shaped area and the light-emitting time of the pixels in the other areas within a frame maybe resulted. Thus, the display area corresponding to the special-shaped area and the other display areas are uneven, which resulting in an abnormal display.

Figure 1B:
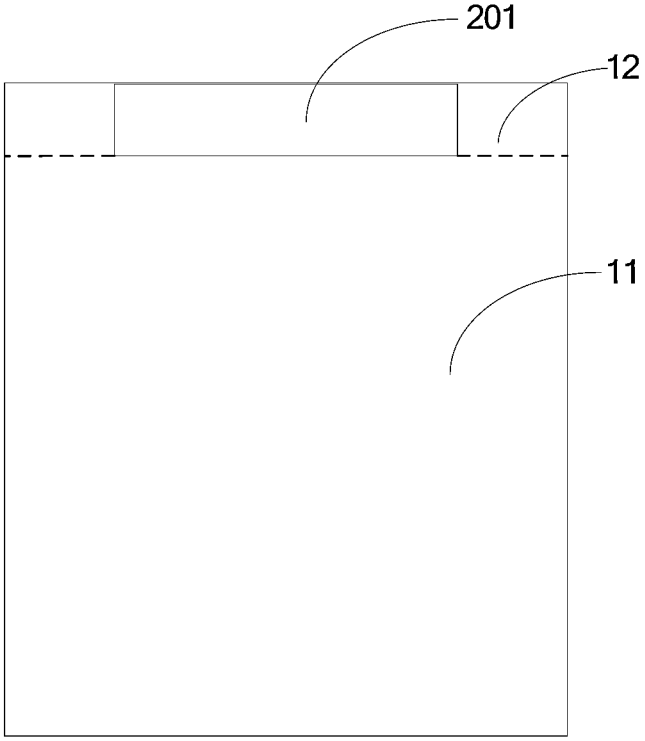

Specifically, the display panel with special-shaped area is a hole-punching screen or a screen with bangs. As shown in FIG. 1*a*, taking the double hole-punching screen as an example, the special-shaped area 201 is set in the display area of the display panel. The special-shaped area 201 includes at least two hole-punching areas 122. The hole-punching areas 122 are isolated by the isolation area 123, so the pixels in the position of the hole-punching area 122 are lost. Moreover, since the isolation area 123 is not configured to display, the isolation area 123 has no light-emitting device. As shown in FIG. 1*b*, taking the screen with bangs as an example, a special-shaped area 201 is set in the display area. The special-shaped area 201 is configured to install cameras and other devices. The existence of the special-shaped area 201 makes some pixels being lost in the display area.

Generally, the pixels in the pixel rows in different area receive the same reference signal, and the pixel driving circuit of the pixels in the same row is connected to the same reference signal line, so that the anode of the light-emitting device in the pixel driving circuit in the same row can be reset in the reset phase. However, since the lack of pixels in the pixel rows in the special-shaped region 201, after the reset phase is completed, the anode voltage of the light-emitting device of the display pixel of the special-shaped area 201 may be different from the anode voltage of the light-emitting device in the display pixel of the normal display area, so that a greater difference in the anode voltage rise time of the light-emitting device is caused, and a greater difference in the light-emitting time of the pixels in the special-shaped area and the other areas within a frame maybe resulted, and a uneven pixel display in the display stage maybe resulted.

In order to overcome the above problems, achieve the purpose of eliminating display differences, and improve display effect in the present application, the present application provides a new technical solution. Technical solutions of the present application will be illustrated clearly and comprehensively by referring to the drawings of embodiments of the display panel and display.

A display panel is provided in the present application. As shown in FIGS. 1*a* and 1*b*, the display panel includes a first area 11 and a second area 12. The display panel includes a plurality of first pixel rows in the first area 11, the display panel includes a plurality of second pixel rows in the second area 12, and each of the first pixel row and the second pixel row includes a plurality of pixels. Specifically, since the special-shaped area 201 is set in the second area 12, some pixels in the second area 12 is lost. Specifically, the number of pixels in each second pixel row in the second area 12 is less than that in each first pixel row in the first area 11. Furthermore, the plurality of pixels located in the first pixel row are a plurality of display pixels, and the plurality of pixels located in the second pixel row are a plurality of display pixels and a plurality of virtual pixels. Moreover, the display pixel includes a display pixel circuit, the virtual pixel includes a virtual pixel circuit, and the virtual pixel circuit includes a compensation unit. The virtual pixel circuit is configured to compensate the display pixel circuits of one of the plurality of second pixel rows when the display pixel circuits of the one of the plurality of second pixel row are reset. Thus, after the display pixel circuits in the first area and the second area are reset, the voltage difference at the nodes of the light-emitting devices (i.e. the anode of the light-emitting device) corresponding to the display pixel circuits is reduced, the difference of the light-emitting between the first area 11 and the second area 12 is reduced, and the display effect is improved.

Specifically, in one embodiment, the virtual pixel circuit and the reset unit of the display pixel circuit located in the same second pixel row in the second area 12 are connected to the same reference signal line. The virtual pixels exist in each second pixel row of the second area 12, and the number of the pixels in the second pixel row of the second area 12 is less than the number of the pixels in the first pixel row of the first area 11. Thus, in the reset stage, the reset voltage is configured to reset the display pixel circuits of different numbers, so that the voltage of the anode of the light-emitting device of the display pixel circuit of the first area 11 and the voltage of the anode of the light-emitting device of the display pixel circuit of the second area 12 may be different, which resulting in a display difference in the display stage. Generally, in order to make the reset voltage being consistent, in the prior art multiple reference signal lines are used. Namely, the second pixel row located in the second area 12 and the first pixel row located in the first area 11 are connected to different reference signal lines, so that the reset voltage of the pixel circuit at the second area 12 and the reset voltage of the pixel circuit the first area 11 are the same, and different area of the display panel has the same display effect. However, the circuit is complex and the display effect is poor. In the present application, since the pixels of the first pixel row located in the first area 11 and the second pixel row located in the second area 12 receive the same reference signal, and the virtual pixel circuit located in the same second pixel row and the reset unit of the display pixel circuit are connected to the same reference signal line, not only the circuit of the display panel is simplified, but also in the reset stage, the compensation unit of the virtual pixel circuit can compensate the load of the display pixel circuit of the second area 12. Thus, the voltage of the anode of the light-emitting devices of the display pixel circuit of the first area 11 and the voltage of the display pixel circuit of the second area 12 are almost the same, the display of both the first area 11 and the second area 12 is uniform, and the display effect is improved.

In one embodiment, if the display panel is a double hole-punching screen as described in FIG. 1*a*, the virtual pixel circuit is set at the isolation area 123. If the display panel is a screen with bangs as shown in FIG. 1*b*, the virtual pixel circuit can be set at the edge of the special-shaped area 201, or the virtual pixel circuit can be set at the frame area of the display panel, as long as the purpose of compensating the display pixel circuit of the second area 12 is achieved, it will not be repeated below.

Figure 2:
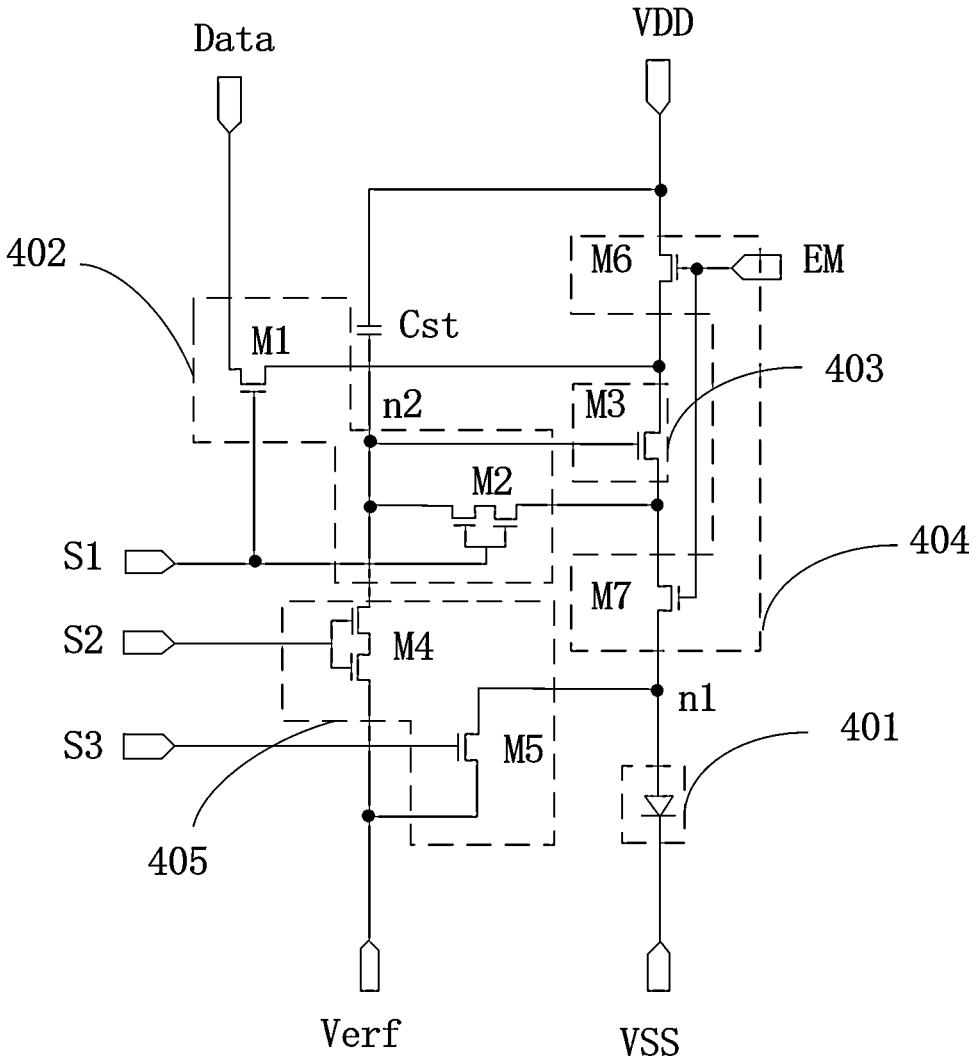
FIG. 2 is a structural schematic view of an embodiment of a display pixel circuit in a first area and a second area of the display panel of the present disclosure.
Figure 3:
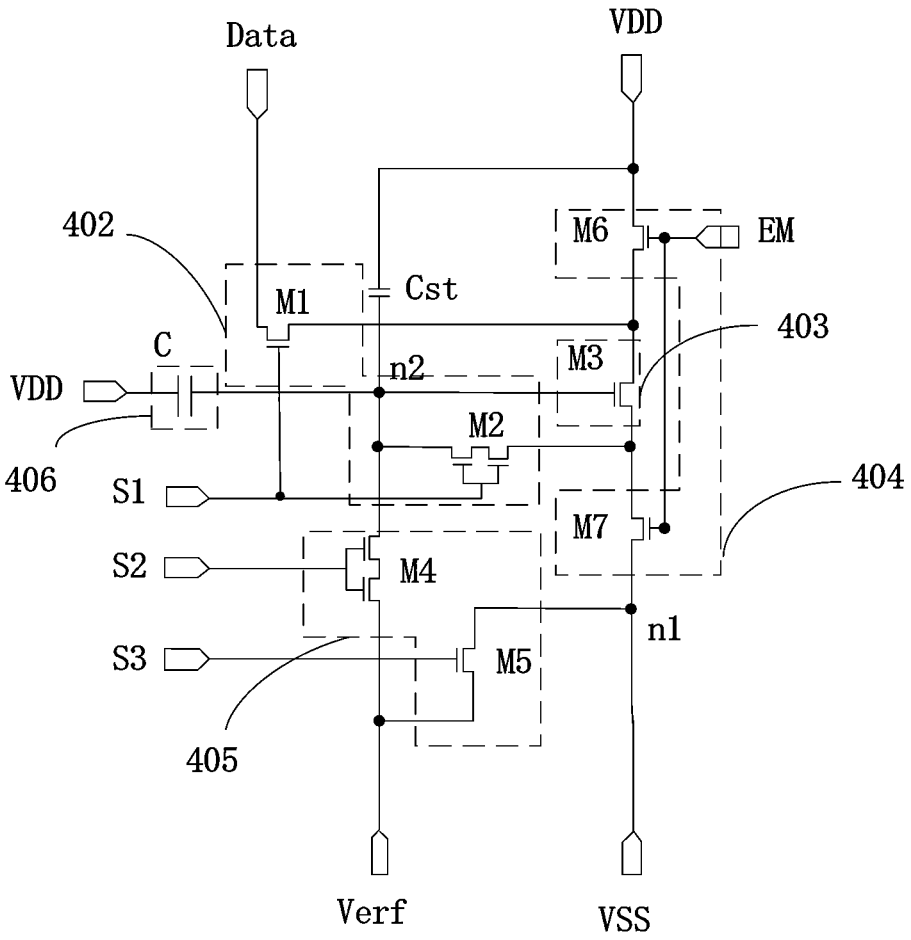
FIG. 3 is a structural schematic view of an embodiment of a virtual pixel circuit in the second area of the present disclosure.

In an embodiment, as shown in FIG. 2 and FIG. 3, FIG. 2 is a structural schematic view of an embodiment of a display pixel circuit in a first area and a second area of the display panel of the present disclosure; and FIG. 3 is a structural schematic view of an embodiment of a virtual pixel circuit in the second area of the present disclosure. Both the display pixel circuit and the virtual pixel circuit include: a writing unit 402, a driving unit 403, a control unit 404, and a reset unit 405. The writing unit 402 is configured to receive the first scanning signal S1 and be driven by the first scanning signal S1 to write the data signal to the driving node n2 in the writing stage. The driving unit 403 is configured to connect to the writing unit 402 by driving the node n2. The control unit 404 is configured to receive the enable signal EM and connect the driving unit 403, so that the driving unit 403 is connected to the power signal line by the control unit 404. The reset unit 405 is configured to receive a second scanning signal, connect the driving node n2 and the control unit 404, the reset unit 405 is driven by the second scanning signal to receive a reference signal Verf, and the reset unit 405 further resets the driving node n2 and the first node n1 which is between the reset unit 405 and the control unit 404 by using the reference signal Verf.

As shown in the structural schematic view of the display pixel circuit shown in FIG. 2, the control unit 404 and the reset unit 405 of the display pixel circuit is connected to the light-emitting device 401 at the first node n1. As shown in the structural schematic view of the display pixel circuit shown in FIG. 3, the driving node n2 of the driving unit 403 of the virtual pixel circuit is connected to a compensation unit 406, and the first node n1 between the control unit 404 and the reset unit 405 of the virtual pixel circuit is not connected to the light-emitting device 401.

In one embodiment, both the display pixels of the first pixel row and the display pixels of the second pixel row are configured to display in the display stage. Therefore, both the display pixels of the first pixel row and the display pixels of the second pixel row have light-emitting devices. Since the virtual pixels are not configured to display in the display stage, the virtual pixels could not include light-emitting devices. The light-emitting device 401 can be an organic light emitting diode OLED, which may include a red OLED, a blue OLED, and a green OLED. In another embodiment, the light-emitting device 401 may also include a white OLED. There is not limited here, which is mainly configured to display on the display panel, as long as the display effect required by the display panel can be achieved.

In one embodiment, the compensation unit 406 is a compensation capacitor or a compensation resistor. Specifically, as shown in FIG. 3, the compensation unit 406 of the virtual pixel circuit is a compensation capacitor, one end of the compensation unit 406 is connected to the driving node n2, and the other end of the compensation unit 406 is connected to the power signal line and configured to receive the power signal VDD. In another embodiment, the compensation unit 406 of the virtual pixel circuit can also be a compensation resistor, which can also be a compensation capacitor as shown in FIG. 3. One end of the compensation unit 406 is connected to the driving node n2, and the other end of the compensation unit 406 is connected to the power signal line and configured to receive the power signal VDD. As long as the compensation unit 406 can play a compensation role in the reset stage, so that the voltage of the first node n1 (anode of the light-emitting device) of the display pixel circuit of the second area 12 and the voltage of the display pixel circuit of the first area 11 are almost the same, it will not be repeated below.

In one embodiment, the driving node n2 of each of the virtual pixel circuit is connected to one compensation capacitor. In another embodiment, in order to make the voltage of the first node n1 (anode of the light-emitting device) of the display pixel circuit of the second area 12 and the voltage of the display pixel circuit of the second area 12 being almost the same after the reset phase is completed, the compensation capacitor can also be connected to the driving node n2 of the virtual pixel circuit. Namely, the number of the compensation capacitors is less than or equal to the number of the virtual pixels. Specifically, in one embodiment, the number of the compensation capacitors is the difference between the number of the virtual pixels in the first pixel row and the number of the virtual pixels in the second pixel row. For example, in the screen with bangs, two hundred pixels are lost in the position of the special-shaped area 201, and the special-shaped area 201 includes 5 the second pixel rows, and forty pixels are lost in each second pixel row, then forty virtual pixel circuits with the compensation capacitor can be set in each second pixel row and connected to the reference signal line of each row.

As shown in FIG. 1*a*, in order to ensure the narrow frame design, the second area 12 may include a virtual pixel area, the virtual pixel area includes two hole-punching areas 122 and an isolation area 123 located between the two hole-punching areas 122, and the virtual pixels are located in the isolation area 123.

In another embodiment, the display panel is as shown in FIG. 1*b*, the virtual pixel can be set at the edge of the special-shaped area 201, and the virtual pixel can also be set at the frame area of the display panel.

There are many specific setting manners of the display pixel circuit and the virtual pixel circuit in the present disclosure. In the embodiment, the 7T1C circuit is used as an example for the display pixel circuit and the virtual pixel circuit. Specifically, in a 7T1C circuit, the writing unit 402 includes a first transistor M1, and a second transistor M2. The first transistor M1 includes a first pathway terminal, a second pathway terminal, and a control terminal. Furthermore, the first pathway terminal of the first transistor M1 is connected to a data signal line and configured to receive the data signal Data. The second pathway terminal of the first transistor M1 is connected to both the driving unit 403 and the control unit 404. Specifically, the second pathway terminal of the first transistor M1 is connected to the first pathway terminal of a third transistor M3 of the driving unit 403 and the second pathway terminal of a sixth transistor M6 of the control unit 404. The control terminal of the first transistor M1 is connected to the first scanning signal line and configured to receive a first scanning signal S1. The second transistor M2 includes a first pathway terminal, a second pathway terminal, and a control terminal. Furthermore, the first pathway terminal of the second transistor M2 is connected to the driving unit 403. Specifically, the first pathway terminal of the second transistor M2 is connected to the control terminal of the third transistor M3 of the driving unit 403 (i.e. the driving node n2). The second pathway terminal of the second transistor M2 is connected to the second pathway terminal of the third transistor M3 of the driving unit 403 and the first pathway terminal of a seventh transistor M7 of the control unit 404. The control terminal of the second transistor M2 is connected to the first scanning signal line and configured to receive the first scanning signal S1.

The driving unit 403 includes a third transistor M3. The third transistor M3 includes a first pathway terminal, a second pathway terminal and a control terminal, furthermore, the first pathway terminal of the third transistor M3 is connected to the control unit 404 and the writing unit 402. Specifically, the first pathway terminal of the third transistor M3 is connected to the second pathway terminal of the sixth transistor M6 of the control unit 404, and the second pathway terminal of the first transistor M1 of the writing unit 402. The second pathway terminal of the third transistor M3 is connected to the control unit 404 and the writing unit 402. Specifically, the second pathway terminal of the third transistor M3 is connected to the first pathway terminal of a seventh transistor M7 of the control unit 404, and the second pathway terminal of the second transistor m2 of the writing unit 402, the control terminal of the third transistor M3 is connected to the reset unit 405 and the writing unit 402. Specifically, the control terminal of the third transistor M3 is connected to the first pathway terminal of the fourth transistor M4 of the reset unit 405 and the first pathway terminal of the second transistor m2 of the writing unit 402.

In the embodiment, the reset unit 405 is configured to receive the second scanning signal, and the reset unit 405 is connected to the driving node n2 of the driving unit 403 and the control unit 404, and the reset unit 405 is driven by the second scanning signal to receive the reference signal Verf, and the reset unit 405 resets the driving node n2 and the first node n1 which is between the reset unit 405 and the control unit 404 according to the reference signal Verf. In one embodiment, the second scanning signal includes a first scanning reset sub-signal S2 and a second scanning reset sub-signal S3. The reset unit 405 includes a first reset sub-unit and a second reset sub-unit. The first reset sub-unit is configured to receive the first scanning reset sub-signal S2 and the reference signal Verf, and the first reset sub-unit connects the driving node n2, and the first reset sub-unit resets the driving node n2 by using the reference signal Verf during the first reset sub-period corresponding to the first scanning reset sub-signal S2. The second reset sub-unit is configured to receive the second scanning reset sub-signal S3 and the reference signal Verf, and the second reset sub-unit connects the first node n1, and the second reset sub-unit resets the first node n1 by using the reference signal Verf during the second reset sub-period corresponding to the second scanning reset sub-signal S3.

The first reset sub-unit includes a fourth transistor M4. The fourth transistor M4 includes a first pathway terminal, a second pathway terminal and, a control terminal. Furthermore, the first pathway terminal of the fourth transistor M4 is connected to the driving unit 403. Specifically, the first pathway terminal of the fourth transistor M4 is connected to the control terminal of the third transistor M3 of the driving unit 403 (i.e. the driving node n2). The second pathway terminal of the fourth transistor M4 is connected to the reference signal line and configured to receive the reference signal Verf. The control terminal of the fourth transistor M4 is connected to a first scanning reset sub-signal line and configured to receive the first scanning reset sub-signal S2.

In one embodiment, the second reset sub-unit includes a fifth transistor M5. The fifth transistor M5 includes a first pathway terminal, a second pathway terminal, and a control terminal. Furthermore, the first pathway terminal of the fifth transistor M5 is connected to the first node n1. Specifically, the first pathway terminal of the fifth transistor M5 is connected to the second pathway terminal of a seventh transistor M7 of the control unit 404. In the display pixel, the first pathway terminal of the fifth transistor M5 is also connected to the anode of the light-emitting device 401. The second pathway terminal of the fifth transistor M5 is connected to the reference signal line and configured to receive the reference signal Verf, and the control terminal of the fifth transistor M5 is connected to a second scanning reset sub-signal line and configured to receive a second scanning reset sub-signal S3.

The control unit 404 includes a sixth transistor M6 and a seventh transistor M7. The sixth transistor M6 includes a first pathway terminal, a second pathway terminal and a control terminal, furthermore, the first pathway terminal of the sixth transistor M6 is connected to the power signal line and configured to receive the power signal VDD, the second pathway terminal of the sixth transistor M6 is connected to the driving unit 403. Specifically, the second pathway terminal of the sixth transistor M6 is connected to the first pathway terminal of the third transistor M3 of the driving unit 403, the control terminal of the sixth transistor M6 is connected to an enable signal line and configured to receive the enable signal EM. The seventh transistor M7 includes a first pathway terminal, a second pathway terminal, and a control terminal. Furthermore, the first pathway terminal of the seventh transistor M7 is connected to the second pathway terminal of the sixth transistor M6, the second pathway terminal of the seventh transistor M7 is connected to the first node n1, and the control terminal of the seventh transistor M7 is connected to the enable signal line and configured to receive the enable signal EM.

In one embodiment, the display pixel circuit and the virtual pixel circuit also include a storage capacitor Cst, the storage capacitor Cst includes a first pathway terminal and a second pathway terminal, the first pathway terminal of the storage capacitor Cst is connected to the power signal line, and the second pathway terminal of the storage capacitor Cst is connected to the control terminal of the third transistor M3.

In the reset phase, both the fourth transistor M4 and the fifth transistor M5 in the reset unit 405 are turned on, and the driving node n2 of the driving unit 403 and the anode of the light-emitting device 401 (i.e., the first node n1) are reset by the reference signal Verf. In the display panel of prior art, since the number of pixels in each row of the second pixel row of the second area 12 is less than that in each row of the first pixel row of the first area 11, the first pixel row and the second pixel row receive the same reference signal. After the reset is completed, the voltage of the anode of the light-emitting device of the display pixel circuit of the first pixel row of the first area 11 is different from the voltage of the anode of the light-emitting device of the display pixel circuit of the second pixel row of the second area 12. Furthermore, the display of the first area 11 and the second area 12 may be uneven and the display effect will be poor, in the writing stage and the light-emitting stage. In the display panel of the present disclosure, the virtual pixels are disposed in each second pixel row, the second pixels and the virtual pixels are connected to the same reference line, and the driving unit of the virtual pixel circuit is connected to the compensation unit at the driving node n2. When resetting in the reset stage, the compensation unit compensates the pixels of one of the second pixel rows, to make the anode of the light-emitting devices of the display pixel circuits of the first area 11 and the second area 12 have almost the same electric potential, so that the voltage difference between the anodes of the light-emitting devices corresponding to the display pixel circuits of the first area 11 and the second area 12 is reduced, and the display of the first area 11 and the second area 12 is uniform, the display effect is improved.

The embodiment takes 7T1C circuit as an example. In other embodiments, the mode of the embodiment can also be applied to, for example, 6t1c circuit, 3t1c circuit, or 8t1c circuit, which is not limited here. As long as the anode voltage of the light-emitting devices in the first area 11 and the second area 12 have almost the same electric potential after the reset phase is completed.

Figure 4A:
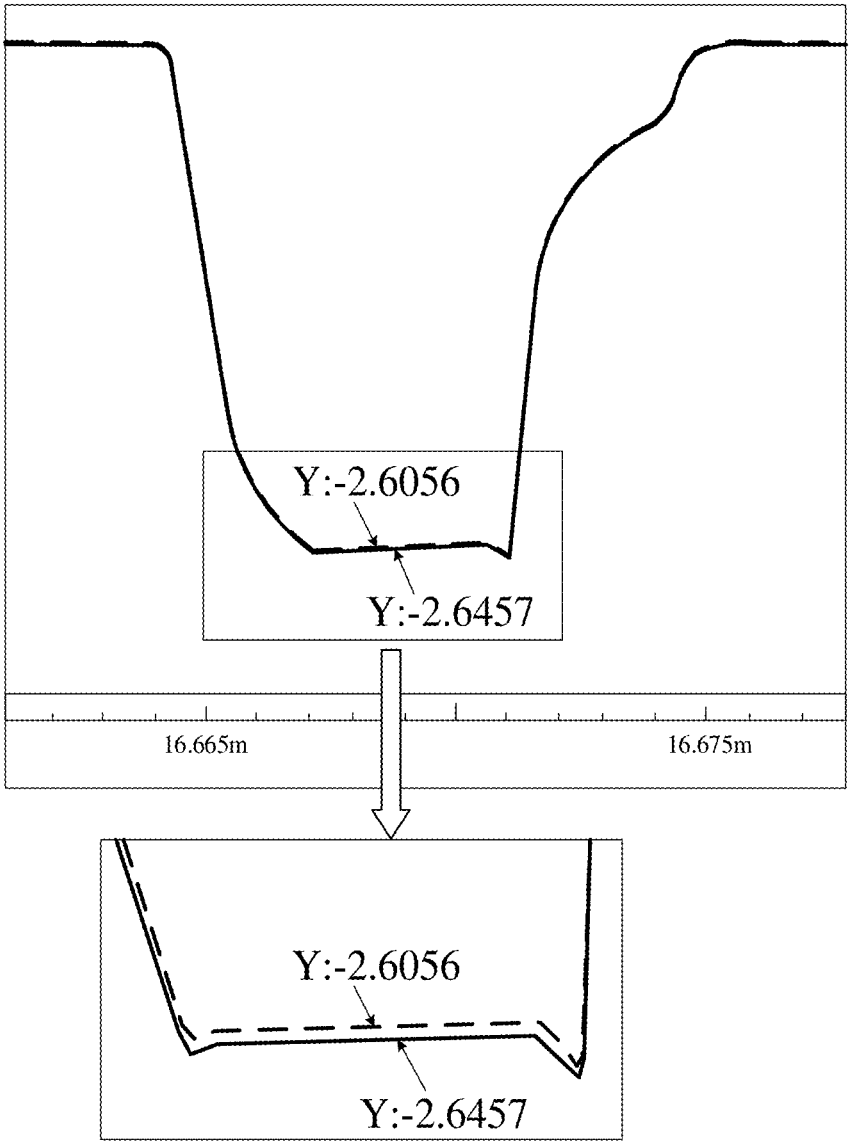
FIG. 4*a* is a voltage simulation view of the first node of the first area and the second area of the display panel in the reset stage of a prior art.

Referring to FIG. 4*a*, FIG. 4*a* is a voltage simulation view of the first node of the first area and the second area of the display panel in the reset stage of the prior art. Furthermore, the anode voltage of the light-emitting device (i.e., the first node n1) corresponding to the display pixel circuit of the second area 12 is −2.6457V after the reset phase is completed, and the anode voltage of the light-emitting device (i.e., the first node n1) corresponding to the display pixel circuit of the first area 11 is −2.6056V after the reset phase is completed. It can be seen that in the display panel of prior art, after the reset phase is completed, the difference between the anode voltage of the light-emitting device corresponding to the display pixel circuit of the first area and the second area is 40.1 mV.

Figure 4B:
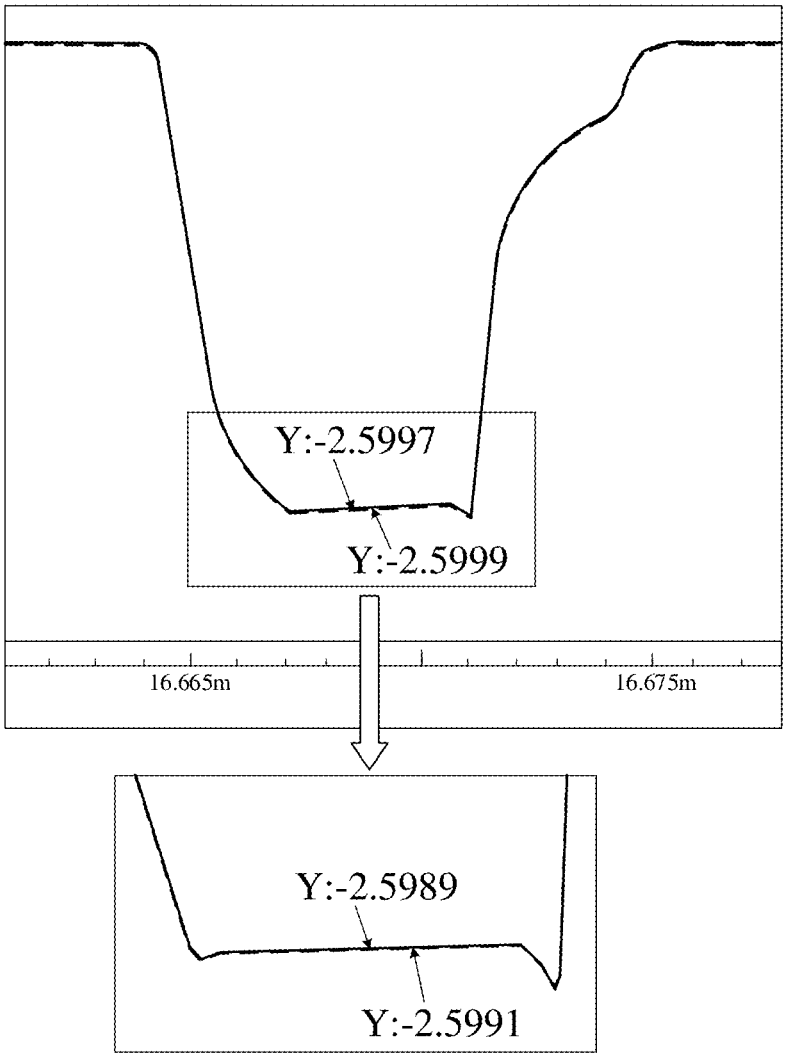
FIG. 4*b* is a voltage simulation view of the first node of the first area and the second area of the display panel in the reset stage of the present disclosure.

Referring to FIG. 4*b*, FIG. 4*b* is a voltage simulation view of the first node of the first area and the second area of the display panel in the reset stage of the present disclosure. Furthermore, under the compensation of the compensation unit of the virtual pixel circuit, the anode voltage of the light-emitting device corresponding to the display pixel circuit of the second area is −2.5997V after the reset phase is completed, and the anode voltage of the light-emitting device corresponding to the display pixel circuit of the first area is −2.5999V after the reset phase is completed. It can be seen that the display panel of the present disclosure, after the reset phase is completed, the difference between the anode voltage of the light-emitting device corresponding to the display pixel circuit of the first area 11 and the second area 12 is 0.2 mV. Compared with the prior art, the technical solution of the present disclosure is significantly reducing the anode voltage of the light-emitting device after the reset phase of the display pixels of the first area 11 and the second area 12 is completed. Furthermore, the difference between the anode voltage of the light-emitting device corresponding to the display pixel circuit of the first area 11 and the second area 12 of the present disclosure is 0.2 mV, which is caused by the accuracy of the simulator. Theoretically, under the compensation of the compensation unit, the anode voltage of the light-emitting device of the display pixel circuit of the first area 11 and the second area 12 is the same after the reset stage is completed by the technical solution of the present disclosure.

The display panel provided by the present disclosure can be a double-sided display panel, a flexible display panel, or a full-screen display panel. The flexible display panel can be applied to a curved electronic device, the double-sided display panel can be applied to the panel which enables the personnel on both sides of the display panel to see the display content, the full-screen display panel can be applied to full-screen mobile phones or other devices, which is not limited here.

In the display panel provided by the present disclosure, by setting a virtual pixel with the virtual pixel circuit in the second pixel row of the second area, the virtual pixel circuit further includes the compensation unit, and the compensation unit is connected to the driving node and the power signal line, the compensation unit compensates the anode voltage of the light-emitting device corresponding to the display pixel circuit of the second area in the reset stage. So that the anode voltage of the light-emitting device corresponding to the display pixel circuit of the second area have almost the same electric potential with the anode voltage of the light-emitting device corresponding to the display pixel circuit of the first area, so as to the display difference between the first area and the second area in the display stage is reduced and the display effect is improved.

Figure 5:
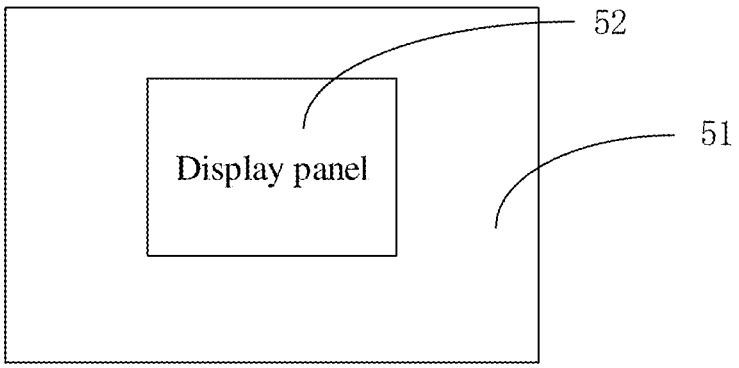
FIG. 5 is a structural schematic view of an embodiment of the display device of the present disclosure.

Referring to FIG. 5, FIG. 5 is a structural schematic view of an embodiment of the display device of the present disclosure. The display device includes the display panel described above.

In one embodiment, the display device can be any product or component with display function, such as mobile phone, tablet computer, television, display, notebook computer, digital photo frame, navigator, etc. Other essential components of the display panel should be understood by those skilled in the art, and that will not be repeated below, nor should it be regarded as a limitation of the present disclosure. The embodiment of the display device can refer to the embodiment of the above display panel, and the repetition will not be repeated.

In each embodiment of the present disclosure, the display panel and display device only describe some related structures, and other structures are the same as those of the display panel and display device in the prior art, which will not be repeated below.

The above description only shows some embodiments of the present disclosure, but does not limit the scope of the present disclosure. Any equivalent structural or process transformation performed based on the drawings and the specification of the present disclosure, directly or indirectly applied in any other related arts, should be within the scope of the present disclosure.

Depending on the exemplary embodiment, certain of the actions of methods described can be removed, others can be added, and the sequence of actions can be altered. It is also to be understood that the description and the claims drawn to a method may include some indication in reference to certain actions. However, the indication used is only to be viewed for identification purposes and not as a suggestion as to an order for the actions.

What is claimed is:

1. A display panel comprising a first area and a second area, comprising:

a plurality of first pixel rows, and each of the first pixel rows comprising a plurality of pixels;

a plurality of second pixel rows, and each of the second pixel rows comprising a plurality of pixels, wherein the number of the pixels of each first pixel row is greater than the number of the pixels of each second pixel row; the plurality of pixels of the first pixel row are a plurality of display pixels, and the plurality of the pixels of the second pixel row are a plurality of display pixels and a plurality of virtual pixels;

each of the plurality of display pixels comprises a display pixel circuit, each of the plurality of virtual pixels comprises a virtual pixel circuit, the virtual pixel circuit comprises a compensation unit, and the virtual pixel circuit is configured to compensate the display pixel circuits of one of the plurality of second pixel rows when the display pixel circuits of the one of the plurality of second pixel rows are reset; so that, after the display pixel circuits in both the first area and the second area are reset, a voltage difference of nodes of light-emitting devices corresponding to the display pixel circuits is reduced;

wherein each of the display pixel circuit and the virtual pixel circuit comprises:

a writing unit, configured to receive a first scanning signal;

a driving unit, wherein the driving unit is connected to the writing unit by a driving node, and the writing unit is driven by the first scanning signal to write a data signal to the driving node in a writing stage;

a control unit, configured to receive an enable signal, wherein the control unit is connected to the driving unit, so that the driving unit is connected to a power signal line by the control unit; and a reset unit, configured to receive a second scanning signal, wherein the reset unit is connected to the driving node and the control unit, the reset unit is driven by the second scanning signal to receive a reference signal, and the reset unit resets the driving node and a first node which is between the reset unit and the control unit according to the reference signal; and wherein one end of the compensation unit is connected to the driving node, and the other end of the compensation unit is connected to the power signal line.

2. The display panel of claim 1, wherein, the first node of the control unit of the display pixel circuit is connected to a light-emitting device, and the driving node of the virtual pixel circuit is connected to the compensation unit.

3. The display panel of claim 2, wherein the pixel of both the plurality of first pixel rows and the plurality of second pixel rows receive a same reference signal, and the reset units of the display pixel circuits and the reset units of the virtual pixel circuits which are disposed in one of the plurality of second pixel rows are connected to the same reference signal line.

4. The display panel of claim 3, wherein the virtual pixel circuit does not comprise the light-emitting device.

5. The display panel of claim 2, wherein the compensation unit is a compensation capacitor or a compensation resistor.

6. The display panel of claim 5, wherein the compensation unit is the compensation capacitor.

7. The display panel of claim 6, wherein the number of compensation capacitors is less than or equal to the number of the virtual pixels.

8. The display panel of claim 6, wherein the number of compensation capacitors is equal to a difference between the number of the pixels of the first pixel row and the number of the pixels of the second pixel row.

9. The display panel of claim 2, wherein the writing unit comprises:

a first transistor comprising a first pathway terminal, a second pathway terminal, and a control terminal; wherein the first pathway terminal of the first transistor is connected to the data signal line and configured to receive the data signal, the second pathway terminal of the first transistor is connected to the driving unit and the control unit, and the control terminal of the first transistor is connected to a first scanning signal line and configured to receive the first scanning signal;

a second transistor comprising a first pathway terminal, a second pathway terminal, and a control terminal; wherein the first pathway terminal of the second transistor is connected to the driving unit, the second pathway terminal of the second transistor is connected to the driving unit and the control unit, and the control terminal of the second transistor is connected to the first scanning signal line and configured to receive the first scanning signal.

10. The display panel of claim 2, wherein the driving unit comprises:

a third transistor comprising a first pathway terminal, a second pathway terminal, and a control terminal; wherein the first pathway terminal of the third transistor is connected to the control unit and the writing unit, and the second pathway terminal of the third transistor is connected to the control unit and the writing unit, the control terminal of the third transistor is connected to the reset unit and the writing unit.

11. The display panel of claim 2, wherein the reset unit comprises:

a first reset sub-unit, configured to receive a first scanning reset sub-signal and the reference signal; wherein the first reset sub-unit is connected to the driving node, and the first reset sub-unit resets the driving node by using the reference signal during a first reset sub-period corresponding to the first scanning reset sub-signal;

a second reset sub-unit, configured to receive a second scanning reset sub-signal and the reference signal; wherein the second reset sub-unit is connected to the first node, and the second reset sub-unit resets the first node by using the reference signal during a second reset sub-period corresponding to the second scanning reset sub-signal.

12. The display panel of claim 11, wherein the first reset sub-unit comprises:

a fourth transistor comprising a first pathway terminal, a second pathway terminal and a control terminal; wherein the first pathway terminal of the fourth transistor is connected to the driving node, the second pathway terminal of the fourth transistor is connected to a reference signal line and configured to receive the reference signal, and the control terminal of the fourth transistor is connected to the first scanning reset sub-signal line and configured to receive the first scanning reset sub-signal.

13. The display panel of claim 11, wherein the second reset sub-unit comprises:

a fifth transistor comprising a first pathway terminal, a second pathway terminal and a control terminal; wherein the first pathway terminal of the fifth transistor is connected to the first node, the second pathway terminal of the fifth transistor is connected to the reference signal line and configured to receive the reference signal, and the control terminal of the fifth transistor is connected to a second scanning reset sub-signal line and configured to receive the second scanning reset sub-signal.

14. The display panel of claim 2, wherein the control unit comprises:

a sixth transistor comprising a first pathway terminal, a second pathway terminal, and a control terminal; wherein the first pathway terminal of the sixth transistor is connected to the power signal line and configured to receive the power signal, the second pathway terminal of the sixth transistor is connected to the driving unit, and the control terminal of the sixth transistor is connected to an enable signal line and configured to receive the enable signal;

a seventh transistor comprising a first pathway terminal, a second pathway terminal, and a control terminal; wherein the first pathway terminal of the seventh transistor is connected to the second pathway terminal of the sixth transistor, the second pathway terminal of the seventh transistor is connected to the first node, and the control terminal of the seventh transistor is connected to the enable signal line and configured to receive the enable signal.

15. The display panel of claim 2, wherein each of the display pixel circuit and the virtual pixel circuit further comprises:

a storage capacitor, comprising a first pathway terminal and a second pathway terminal; wherein the first pathway terminal of the storage capacitor is connected to the power signal line, and the second pathway terminal of the storage capacitor is connected to the driving unit.

16. The display panel of claim 1, wherein the second area comprises:

a virtual pixel area, wherein the virtual pixel area comprises two hole-punching areas and an isolation area between the two hole-punching areas, and the plurality of virtual pixels are located in the isolation area.

17. A display device, comprising a display panel according to claim 1.

* * * * *